US010745967B2

(12) United States Patent
Kao

(10) Patent No.: US 10,745,967 B2
(45) Date of Patent: Aug. 18, 2020

(54) CURTAIN CONTROLLER FOR EASILY ASSEMBLING BEAD CHAIN

(71) Applicant: UNI-SOLEIL ENT. CO., LTD., Tainan (TW)

(72) Inventor: Yu-Ting Kao, Tainan (TW)

(73) Assignee: Uni-Soleil Ent. Co., Ltd., Tainan (TW)

( * ) Notice: Subject to any disclaimer, the term of this patent is extended or adjusted under 35 U.S.C. 154(b) by 216 days.

(21) Appl. No.: 15/843,231

(22) Filed: Dec. 15, 2017

(65) Prior Publication Data

US 2019/0186197 A1 Jun. 20, 2019

(51) Int. Cl.
*E06B 9/78* (2006.01)
*E06B 9/40* (2006.01)

(52) U.S. Cl.
CPC *E06B 9/78* (2013.01); *E06B 9/40* (2013.01); *E06B 2009/785* (2013.01)

(58) Field of Classification Search
CPC ..... E06B 9/78; E06B 2009/785; E06B 9/40
USPC ..... 160/127, 130, 237, 238, 330, 332, 903, 160/DIG. 10, DIG. 11
See application file for complete search history.

(56) References Cited

U.S. PATENT DOCUMENTS

2013/0244824 A1* 9/2013 Clark ..... F16H 1/32 475/162

FOREIGN PATENT DOCUMENTS

TW M301271 U 4/1995
TW M496429 U 3/2015

* cited by examiner

*Primary Examiner* — Justin V Lewis
(74) *Attorney, Agent, or Firm* — Rosenberg, Klein & Lee

(57) ABSTRACT

A curtain controller for easily assembling a bead chain thereof is provided. A bead chain turntable is disposed on an assembling terminal surface of a fixing seat. A positioning seat is combined with the fixing seat to clamp and position the bead chain turntable. A protective cover is assembled on an outer side of the positioning seat. A shielding part is disposed at one side of the protective cover to correspond to an upper edge of the assembling terminal surface of the fixing seat. A fastening groove is disposed at an outer edge of the assembling terminal surface of the fixing seat. A fastening flange is disposed on the shielding part of the protective cover to be inserted into and combined with the fastening groove. A ladder section is formed between a lower side of the fastening flange and the shielding part.

5 Claims, 6 Drawing Sheets

CURTAIN CONTROLLER FOR EASILY ASSEMBLING BEAD CHAIN

BACKGROUND

Field of Invention

The disclosure relates to a curtain controller for easily assembling bead chain. More particularly, the disclosure relates to a curtain controller, which can block the bead chain to prevent the bead chain from sliding into the gap between the shielding part of the shielding cover and the connecting terminal face of the fixing seat when a user pulls the bead chain in a wrong direction or with an excessive force. Therefore, the curtain controller can increase the practical efficacy features thereof, and can be easily assembled with curtain bead chain.

Description of Related Art

With the ever-changing technology and the improvement of living standards of the people, people's requirements for the quality of home living environment are also gradually increasing. In the area of living, various types of doors and windows are an important device. They are not only related to housing lighting and ventilation needs, but also provide windbreak and waterproof function. Therefore, improving the quality of living environment is really dependent on well-designed windows and doors. Curtains are used to cover windows and doors, and have functions of being beautiful, as well as shading and adjusting the intensity of light irradiation. Due to the hue, styles and patterns of the curtains directly affect the overall effect of the entire home, the curtain is naturally the focus when a house needs renovation and dress. As long as curtains are changed to different colors or large floral patterns, bedroom expression is immediately enriched to create a happy atmosphere.

The general structure of the curtain is mainly a curtain cloth wound on the shaft. The shaft is connected with a controller, and a bead chain is wound around the controller. By pulling the bead chain to drive the shaft to rotate forward or reverse via the controller, the curtain can be controlled to ascend or descend. Since the overall length of the bead chain needs to be adjusted according to the length of the drape of the curtain fabric, the setting of the bead chain is often done at the construction site according to the size of the window, and installation is then performed. The bead chain is a ring composed of a series connected beads, and the bead chain needs to be wound on the seat of the controller. However, the bead chain can be installed on the seat of the controller only after disassembling the present curtain structure with tools. Hence, the assembling of the bead chain is quite inconvenient.

A "bead chain wheel of curtain" is disclosed in TW M301271U published on Nov. 21, 2006. The bead chain wheel comprises an outer seat having an external sheet. An outer seat tube is extended from the center of the outer seat. The extending terminal is an outer seat core assembly having a seat ladder with a fall on a front end thereof. The outer seat tube encloses a spring having spring protrusions on both ends. An outer seat ring is vertically extended from the external sheet. A bead seat is composed of a seat ring connected to a seat turn. The center of the bead seat is penetrated by a seat hole. Some bead rooms are disposed on the periphery of the seat ring. An inner sleeve is composed of an inner tube and an inner annular sheet with a larger outer diameter. The inner sleeve is penetrated by an inner hole. The inner wall of the inner tube has a fall to form a tube ladder. The bead seat encloses the outer seat tube, and the outer seat core assembly penetrates the inner hole of the inner sleeve and is fastened on the outer edge of the inner sleeve to be assembled and positioned. When the seat ladder is fastened on the tube ladder, the sear ladder is not covered by the outer seat ring. However, although no tools are needed to fast assemble the "bead chain wheel of curtain," the outer seat is pulled outward when the bead chain is installed. The outer seat is retreated from the inner annular sheet of the inner sleeve, so that the bead rooms can be exposed when the seat ladder is fastened on the tube ladder. Therefore, the bead seat is not limited to escape from the inner sleeve, and a re-installation is inconveniently needed. In the operation process, the outer ring of the outer seat is only against the inner annular sheet of the inner ring to have a gap. Therefore, when the bead chain is pulled in a deviated direction and with an excessive force, the bead chain escapes from the bead seat to be stuck between the outer seat and the inner sleeve. Hence, other tools are needed to move the bead chain back into the bead rooms. This is very inconvenient.

A "quickly-assembled bead chain curtain controller" is disclosed in TW M496429U, published on Mar. 1, 2015. The controller comprises a fixing seat, a bead chain turntable, a spring and a socket sequentially enclosed and assembled as one. A disc body is formed on one end of the socket adjacent to the fixing seat, and an upper edge of a disc body of the fixing seat has a protective cover. Two insertion trenches are separately disposed on the periphery of the disc body of the socket to receive two sides of a bead chain. However, although no tools are needed to quickly assemble the "quickly-assembled bead chain curtain controller," it is found that a gap exists between the protective cover and the disc body since they are only abutted together. Therefore, when the bead chain is pulled in a deviated direction and with an excessive force, the bead chain escapes from the bead chain turn table to be stuck between the fixing seat and the disc body of the socket. Hence, other tools are also needed to move the bead chain back into the bead chain turntable. There is still room for improvement in the overall structural design.

Therefore, in view of the foregoing drawbacks, the inventors develop this curtain controller that can conveniently assemble bead chain by the many-year manufacturing and design experience and knowledge in the related fields and ingenuity to achieve the purpose of better practical value.

SUMMARY

A main aspect of this invention is to provide a curtain controller for easily assembling a bead chain. A bead chain turntable is disposed on an assembling terminal surface of a fixing seat. A positioning seat is combined with the fixing seat to clamp and position the bead chain turntable. A protective cover is assembled on an outer side of the positioning seat. A shielding part is disposed at one side of the protective cover to correspond to an upper edge of the assembling terminal surface of the fixing seat. A fastening groove is disposed on an outer rim of the assembling terminal surface of the fixing seat. A fastening flange is disposed on the shielding part of the protective cover to be inserted into and combined with the fastening groove. A ladder section is formed between a lower side of the fastening flange and the shielding part. When the pulling direction of the bead chain is deviated or the pulling force is too large, the bead chain can be blocked from sliding and inserting between the shielding part of the protective cover and the assembling terminal surface of the fixing seat.

DETAILED DESCRIPTION

To more completely and clearly illustrate the technical means and effects of this invention, the detailed descriptions are set forth below. Please refer to the disclosed figures and the reference numbers.

Figure 1:
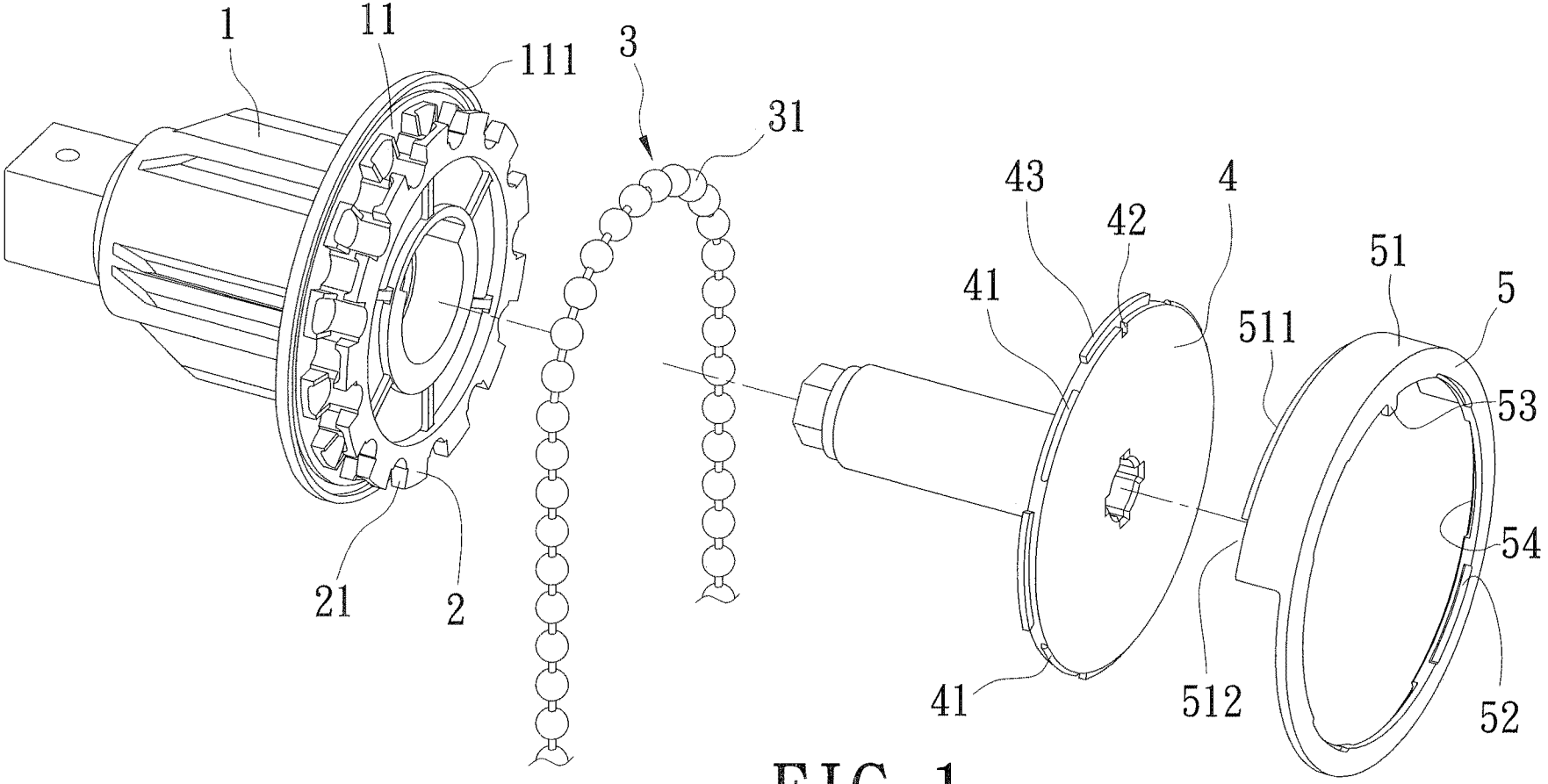
FIG. 1 is a three-dimensional exploded structure diagram of this invention.
Figure 2:
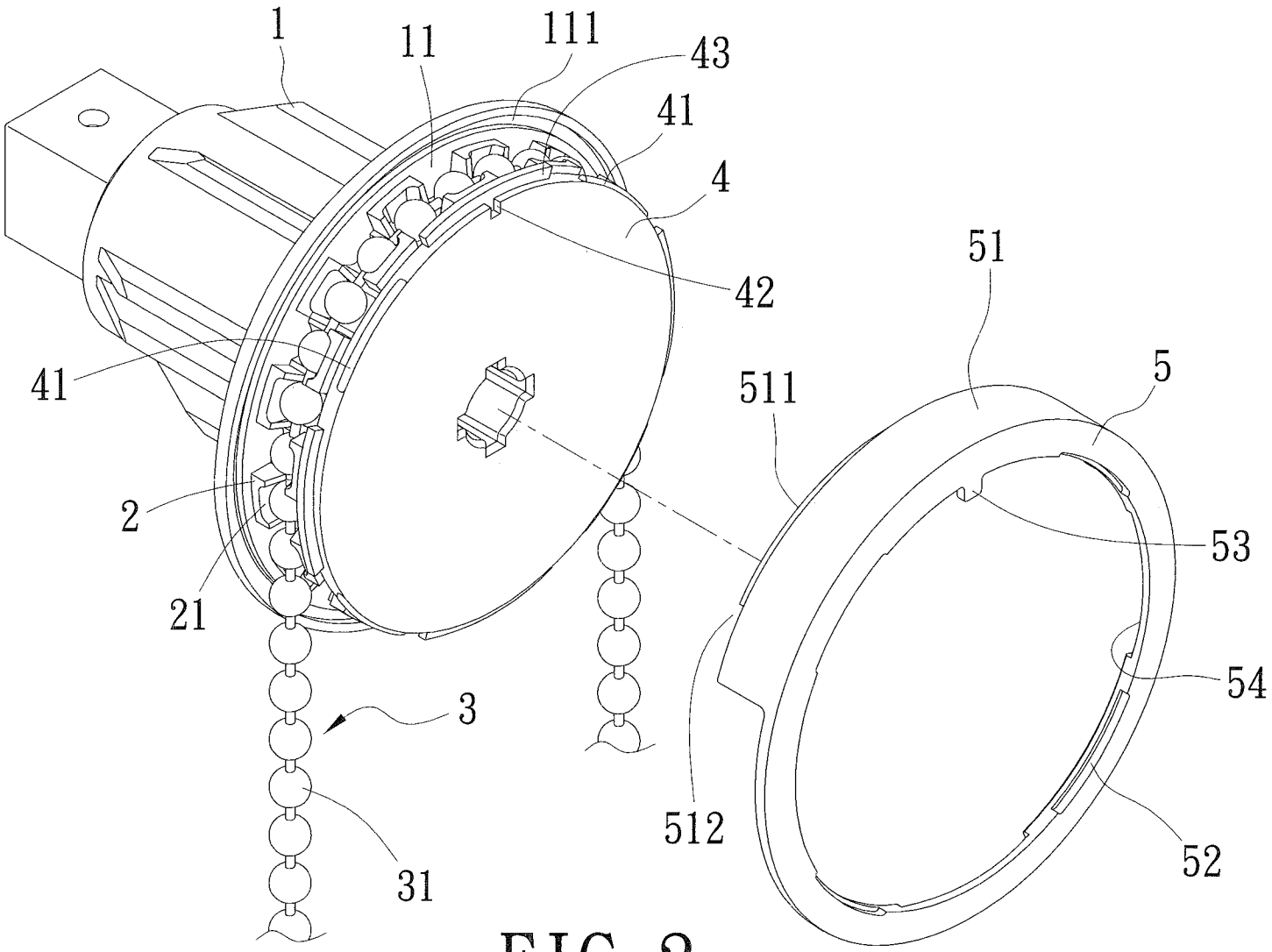
FIG. 2 is a partial three-dimensional exploded structure diagram of this invention.

First, please refer to FIGS. 1 and 2, which are a three-dimensional decomposed structure diagram of this invention and a partial three-dimensional decomposed structure diagram of this invention, respectively. The curtain controller comprises a fixing seat 1, a bead chain turntable 2, a bead chain 3, a positioning seat 4, and a protective cover 5. One side of the fixing seat 1 forms an assembling terminal surface 11 for disposing the bead chain turntable 2. Several recess parts 21 are arranged to surround the periphery of the bead chain turntable 2, such that the bead chain 3 can surround the bead chain turntable 2, and beads 31 of the bead chain 3 are inserted in the recess parts 21 of the bead chain turntable 2. The positioning seat 4 and the fixing seat 1 are combined to clamp and fix the bead chain turntable 2 between the fixing seat 1 and the positioning seat 4. Several fastening strips 41 and a foolproof groove 42 are disposed on an outer periphery of the positioning seat 4, and a protective cover 5 is assembled and fixed on an outer side of the positioning seat 5. Several fastening slots 52 and a foolproof bump 53 are disposed on the protective cover 5 to respectively correspond to the fastening strips 41 and the foolproof groove 42. In order to reach a better fastening effect, several positioning strips 43 are further disposed on the outer periphery of the positioning seat 4. The positioning strips 43 and the fastening strips 41 are alternatively disposed, and positioning slots 54 are disposed on the protective cover 5 to fit the positioning strips 43. A shielding part 51 is prominently disposed at one side of the protective cover 5 to correspond to an upper edge of the assembling terminal surface 11 of the fixing seat 1. The bead chain turntable 2 and the bead chain 3 are shielded by the shielding part 51.

A fastening groove 111 is disposed at an outer rim of the assembling terminal surface 11 of the fixing seat 1. A fastening flange 511 is disposed on the shielding part 51 of the protective cover 5 to fit the fastening groove 111. A ladder section 512 is disposed between a lower side of the fastening flange 511 and the shielding part 51.

Figure 3:
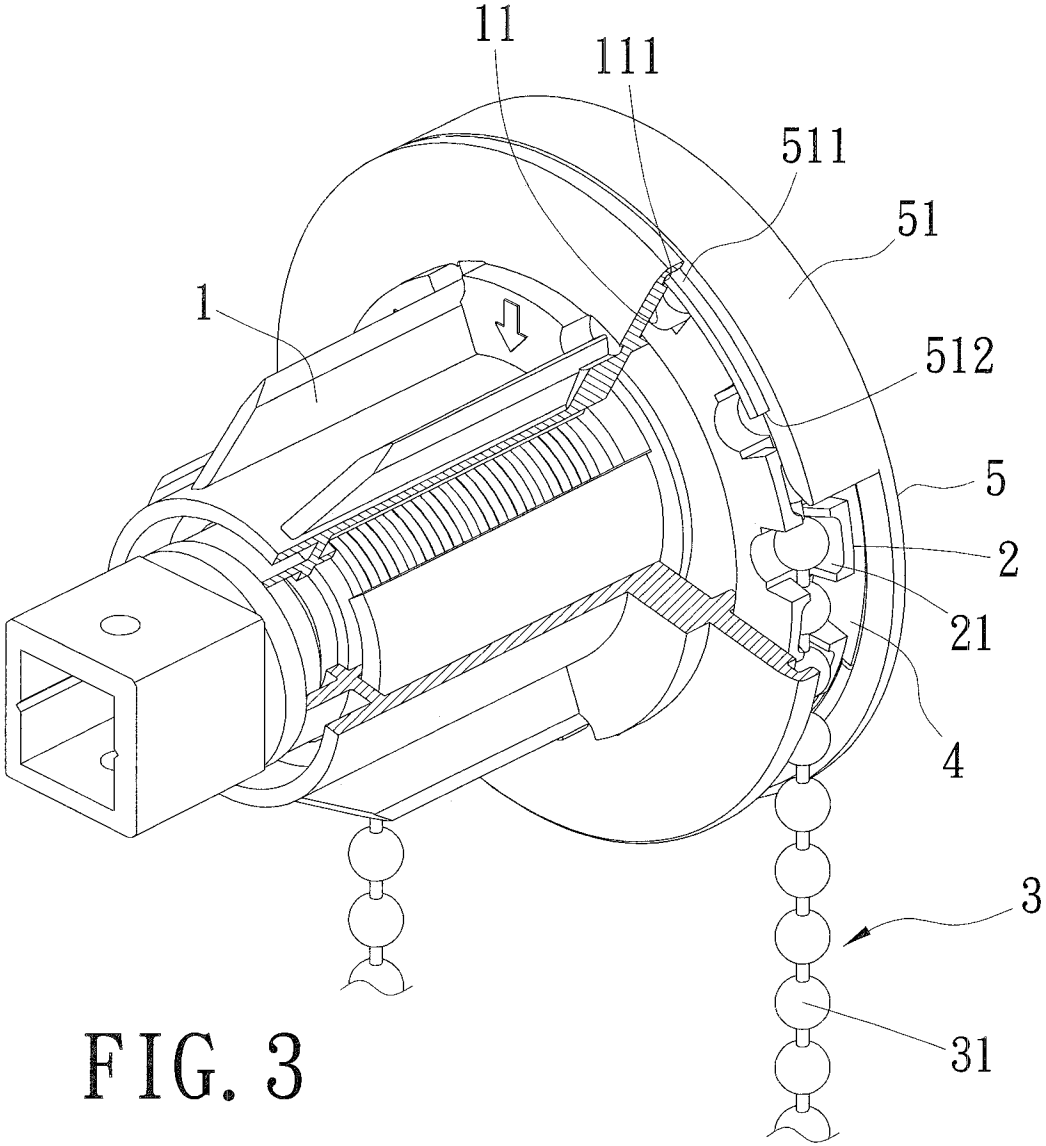
FIG. 3 is a three-dimensional assembling cross-sectional structure diagram of this invention.
Figure 4:
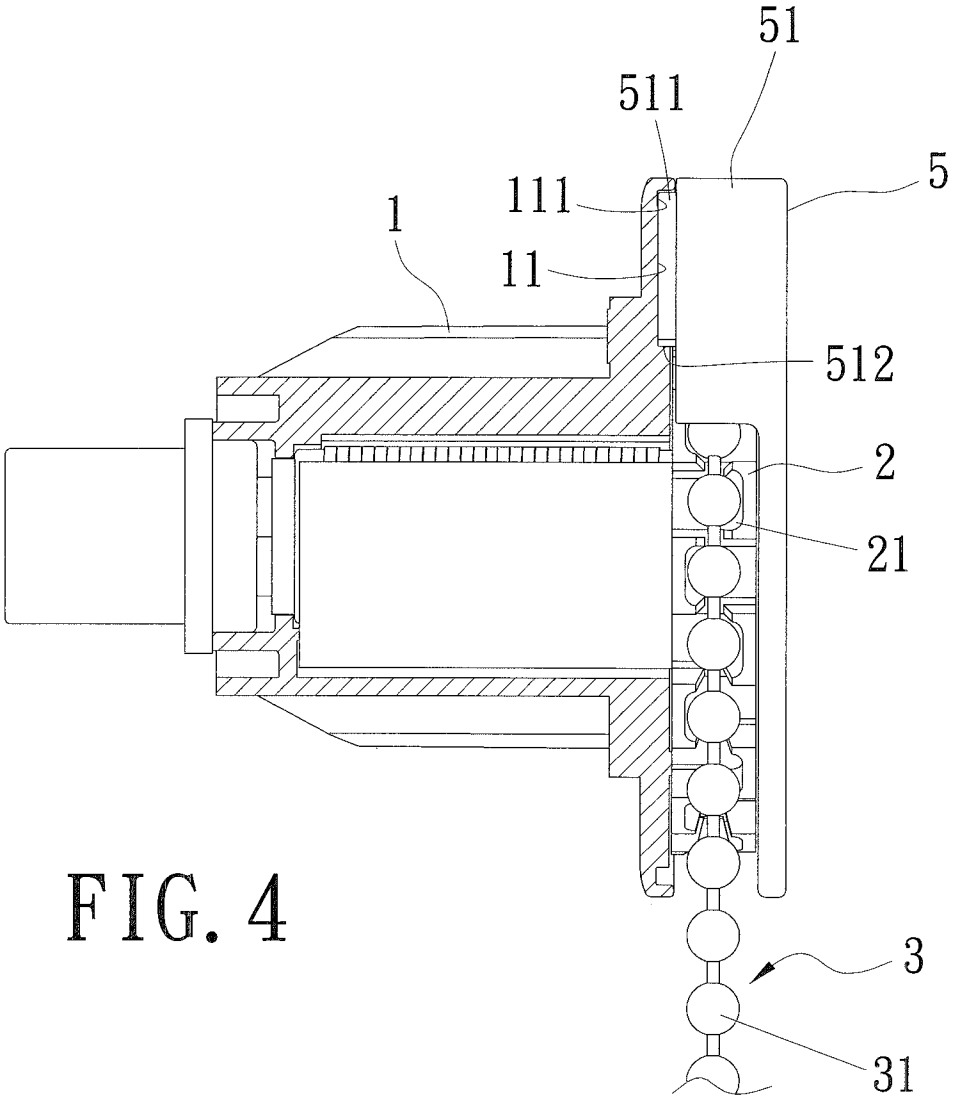
FIG. 4 is an assembling cross-sectional structure diagram of this invention in a side view.

Please refer to FIGS. 3 and 4, which respectively are a three-dimensional assembling cross-sectional structure diagram of this invention and an assembling cross-sectional structure diagram of this invention in a side view. When the parts above are assembled to combine and fix the positioning seat 4 and the fixing seat 1, the bead chain turntable 2 is fasten between the positioning seat 4 and the fixing seat 1. After the bead chain 3 is installed on the bead chain turntable 2, the protective cover 5 is assembled on the outer side of the positioning seat 4. In the assembling of the protective cover 5, the foolproof bump 53 of the protective cover 5 are corresponding to the foolproof groove 42 of the positioning seat 4, the shielding part 51 of the protective cover 5 shields the turntable 2 and an upper part of the bead chain 3, and the fastening flange 511 of the protective cover 5 is inserted and fastened in the fastening groove 111 of the assembling terminal surface 11 of the fixing seat 1. The protective cover 5 is then pressed, so that the fastening slots 52 of the protective cover 5 are corresponding to the fastening strips 41 on the outer peripheral side of the positioning seat 4 to combine and fix the protective cover 5 to the fixing seat 1. Therefore, when the pulling direction of the bead chain 3 is deviated or the pulling force is too large, the bead chain 3 can be blocked from sliding and inserting between the shielding part 51 of the protective cover 5 and the assembling terminal surface 11 of the fixing seat 1. This is because that the fastening flange 511 of the protective cover 5 is inserted in to the fastening groove 111 of the fixing seat 1, and the ladder section 512 is formed between the lower end of the fastening flange 511 and the shielding part 51.

Figure 5:
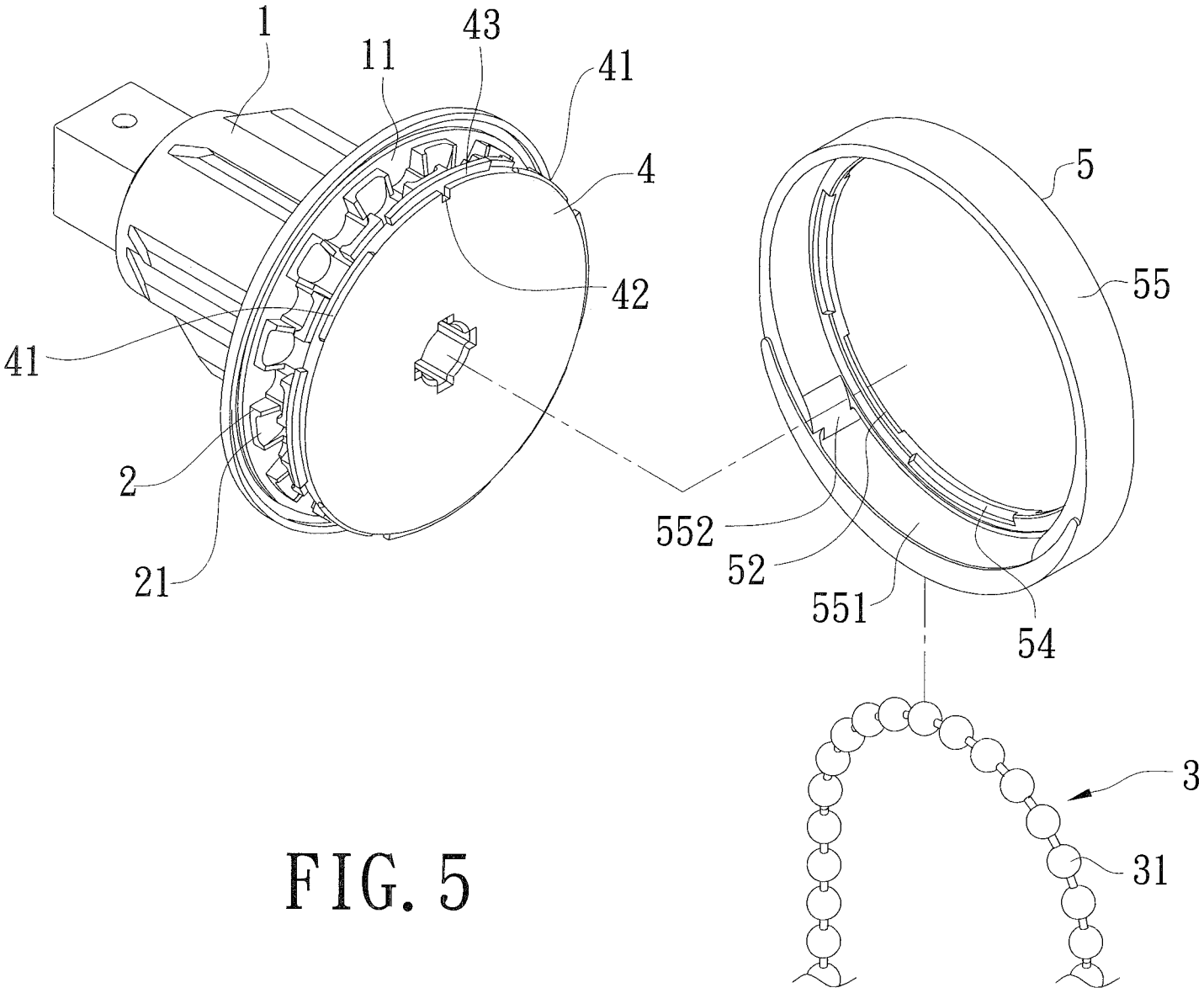
FIG. 5 is a partial three-dimensional exploded structure diagram according to another embodiment of this invention.
Figure 6:
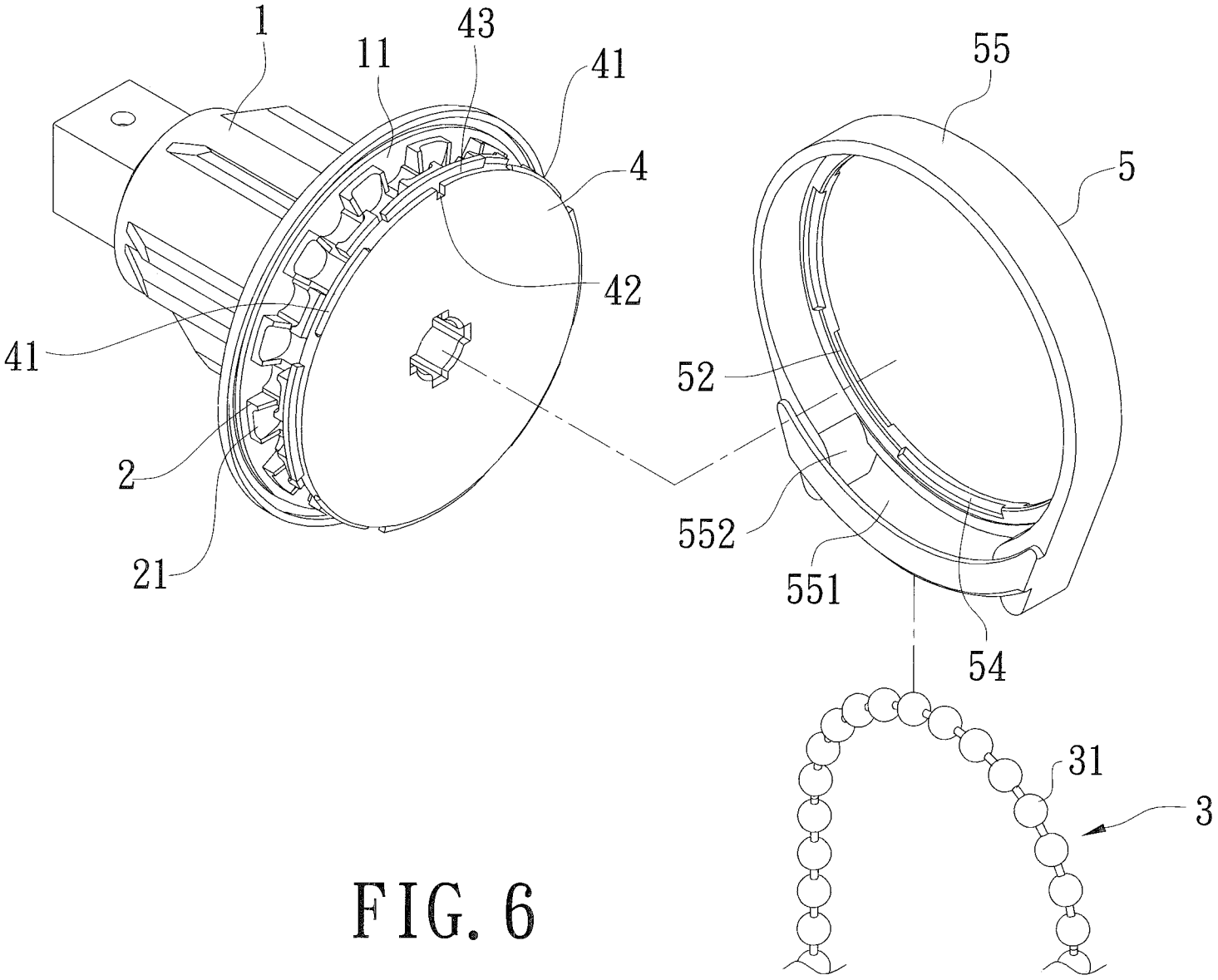
FIG. 6 is a partial three-dimensional exploded structure diagram according to yet another embodiment of this invention.

Furthermore, please refer to FIGS. 5 and 6, which are a partial three-dimensional decomposed structure diagram according to another embodiment of this invention and a partial three-dimensional decomposed structure diagram according to yet another embodiment of this invention. In this invention, a shielding ring 55 may be disposed on an outer rim of one terminal, corresponding to the assembling terminal surface 11 of the fixing seat 1, of the protective cover 5 to shield an outer periphery of the turntable 2. A through hole 551 is disposed on a bottom side of the shielding ring 55, and guiding inclined surfaces 552 are disposed on two sides of the through hole 551 for the bead chain 3 sliding thereon. In the assembling, the bead chain 3 penetrates the through hole 551, and then the bead chain 3 is installed on the bead chain turntable 2. The protective cover 5 is assembled and fixed on the outer side of the positioning seat 4. When the pulling direction of the bead chain 3 is deviated or the pulling force is too large, the bead chain 3 will be limited by the through hole 551 to prevent the bead chain 3 from sliding and inserting between the protective cover 5 and the fixing seat 1.

In light of the foregoing embodiments of this invention, it can be known that the bead chain can be stopped to prevent from sliding and inserting between the shielding part of the protective cover and the assembling terminal surface of the fixing seat when the pulling direction of the bead chain is deviated or the pulling force is too large. Therefore, the practical effect of the curtain controller can be further increased.

What is claimed is:

1. A curtain controller having a bead chain, comprising:

a fixing seat having an assembling terminal surface, wherein a fastening groove is formed adjacent an outer rim of the assembling terminal surface of the fixing seat;

a bead chain turntable disposed on the assembling terminal surface of the fixing seat;

a bead chain partially surrounding the bead chain turntable;

a positioning seat combined with the fixing seat to clamp the bead chain turntable against the fixing seat, a portion of the bead chain and the bead chain turntable thereby being disposed between the positioning seat and the fixing seat, wherein a plurality of fastening strips and positioning strips are alternately disposed on an outer periphery of the positioning seat; and a protective cover fastened against an outer side of the positioning seat, wherein:

the protective cover includes a plurality of fastening slots and a plurality of positioning slots for respectively receiving the fastening strips and the positioning strips of the positioning seat, the protective cover includes a shielding part configured to extend to an upper edge of the assembling terminal surface of the fixing seat for shielding the bead chain turntable and an upper part of the bead chain to block the bead chain from sliding along the assembling terminal surface, and a fastening flange is disposed on the shielding part to correspond to the fastening groove, and a ladder section is formed between a lower side of the fastening flange and the shielding part.

2. The curtain controller of claim 1, wherein the outer periphery of the positioning seat is formed with a groove, and the protective cover is formed with a bump to be inserted into the groove for fastening to each other.

3. A curtain controller having a bead chain, comprising:

a fixing seat having an assembling terminal surface;

a bead chain turntable disposed on the assembling terminal surface of the fixing seat;

a bead chain partially surrounding the bead chain turntable;

a positioning seat combined with the fixing seat to clamp the bead chain turntable against the fixing seat, a portion of the bead chain and the bead chain turntable thereby being disposed between the positioning seat and the fixing seat, wherein a plurality of fastening strips and positioning strips are alternately disposed on an outer periphery of the positioning seat; and a protective cover fastened against an outer side of the positioning seat, wherein:

the protective cover includes a plurality of fastening slots and a plurality of positioning slots for respectively receiving the fastening strips and the positioning strips of the positioning seat, the protective cover includes a shielding ring configured to extend from an outer rim of the protective cover for shielding an outer periphery of the bead chain turntable to block the bead chain from sliding along the assembling terminal surface, and a through hole is defined at a bottom of the shielding ring for passage of the bead chain through the shielding ring.

4. The curtain controller of claim 3, wherein the shielding ring has guiding inclined surfaces disposed on two sides of the through hole.

5. The curtain controller of claim 3, wherein the outer periphery of the positioning seat is formed with a groove, and the protective cover is formed with a bump to be inserted into the groove for fastening to each other.

* * * * *